United States Patent [19]

Van Halen

[11] Patent Number: 4,656,917

[45] Date of Patent: Apr. 14, 1987

[54] MUSICAL INSTRUMENT SUPPORT

[76] Inventor: Edward L. Van Halen, 1900 Ave. of Stars #1780, Los Angeles, Calif. 90067

[21] Appl. No.: 760,598

[22] Filed: Jul. 30, 1985

[51] Int. Cl.[4] ..... G10G 5/00

[52] U.S. Cl. ..... 84/327; 224/910

[58] Field of Search ..... 84/327, 453, 267, 280, 84/411, 421; 224/910; 248/444, 371, 443

[56] References Cited

U.S. PATENT DOCUMENTS

| | | | |
|---|---|---|---|
| 1,285,802 | 11/1918 | Russell . | |
| 1,945,162 | 1/1934 | Rasmussen . | |
| 2,814,229 | 11/1957 | Vaccaro et al. . | |
| 3,371,570 | 3/1968 | Lester . | |
| 3,955,461 | 5/1976 | Ivie . | |
| 3,979,993 | 9/1976 | Proctor | 84/453 |
| 4,213,369 | 7/1980 | Swartwout . | |

*Primary Examiner*—S. J. Witkowski
*Assistant Examiner*—David Warren
*Attorney, Agent, or Firm*—Lerner, David, Littenberg, Krumholz & Mentlik

[57] ABSTRACT

A supporting device for stringed musical instruments, for example, guitars, banjos, mandolins and the like, is disclosed. The supporting device is constructed and arranged for supporting the musical instrument on the player to permit total freedom of the player's hands to play the instrument in a completely new way, thus allowing the player to create new techniques and sounds previously unknown to any player. The device, when in its operational position, has a plate which rests upon the player's leg leaving both hands free to explore the musical instrument as never before. Because the musical instrument is arranged perpendicular to the player's body, the player has maximum visibility of the instrument's entire playing surface.

22 Claims, 4 Drawing Figures

MUSICAL INSTRUMENT SUPPORT

BACKGROUND OF THE INVENTION

The present invention relates in general to a stabilizing support for a musical instrument of the type having a body and fretted neck, e.g., guitars, banjos, mandolins and the like, and more particularly, to a musical instrument mounted device which positions the instrument in a substantially perpendicular orientation to a musician's body to provide total freedom for the musician's hands to play the instrument in a completely new way, thus allowing the musician to create new techniques and sounds previously unknown to any musician.

One such musical instrument to which the stabilizing support of the present invention is uniquely suited is the guitar. As a stringed musical instrument, the guitar is capable of being played by a variety of techniques which produce an equal variety of acoustical effects. In all such circumstances, the guitar is oriented with respect to the guitar player's body in a manner to facilitate the manipulation of the sound reproducing strings by the player's hands and fingers in an uninhibited manner. To create new playing techniques and sounds, it is desirable that the guitar be supported in a manner which leaves both hands of the player free to explore the strings which overlie the guitar body and fretted neck. In addition, as nearly all musicians prefer to view the fretted neck of the guitar as they are playing, to be sure that the proper notes or chords are being fingered, it is desirable that the guitar be arranged to afford the player maximum visibility of the guitar playing surface.

If the musician is in a sitting position, the guitar can usually be rested across the player's lap and supported by the player's legs. Even when sitting, it is sometimes desirable to provide means for supporting the guitar, other than directly against the player's legs. For example, U.S. Pat. No. 1,285,802 discloses a device which is attached to the fretted neck to facilitate supporting the guitar when the musician is in a sitting position. However, it is not always possible, or even desirable, to be in a sitting position. Furthermore, even if it is possible, many musicians prefer to play from a standing position. This is particularly true of musicians who sing while they accompany themselves on the guitar. Of course, various types of support straps have been devised, which usually attach at opposite ends to the guitar body and fretted neck for placing about the neck and shoulders of the musician. These straps do not serve the purpose of leaving both hands of the guitar player free to explore the guitar, as well as maintaining the guitar in a substantially perpendicular orientation to the player's body for a better view of the fretted neck. In fact, these straps tend to position the instrument in a substantially vertical orientation, so that the musician must still exert effort, generally with the hand gripping the fretted neck, so as to position the instrument in an oblique plane for better playing of the frets.

Accordingly, there remains as unsolved need for a universally acceptable device for stringed musical instruments of the type having a body and fretted neck, suitable both for supporting and positioning the instrument for better viewing of the playing surface and leaving both of the musician's hands free to explore the musical instrument while the musician is standing.

SUMMARY OF THE INVENTION

It is broadly an object of the present invention to provide a musical instrument support for supporting a stringed musical instrument in an angular orientation to a player's body to allow the player to create new techniques and sounds previously unknown to any player, in a manner which overcomes or avoids one or more of the foregoing disadvantages resulting from the use of the above-mentioned prior art device, and which fulfills the specific requirements of such a musical instrument support for use with, for example, guitars, banjos, mandolins and the like.

Specifically, it is within the contemplation of one aspect of the present invention to provide a musical instrument support which permits playing of the instrument while the musician is standing, either in a unique perpendicular orientation for maximum visibility of the entire playing surface, or in a conventional vertical orientation when and as desired by the musician.

In accordance with one embodiment of the present invention, there is described a stringed musical instrument constructed of an instrument body having front and rear surfaces, sound producing means extending over a portion of the front surface, and a device mounted onto the rear surface for positioning the instrument body in an angular orientation to a player's body, the device including an attachment movable between an inoperative position overlying the rear surface and an operative position at an angle to the rear surface, the attachment engaging the player's body when in the operative position for maintaining the instrument body in the angular orientation and disengaging from the player's body when in the inoperative position for maintaining the instrument body in other than the angular orientation.

In accordance with the above embodiment, the device further includes a pair of spaced-apart mounting blocks attached to the rear surface and a rod extending therebetween, and wherein the attachment is movably mounted on the rod for rotational movement between the operative and inoperative positions and for lateral movement between a locked and unlocked position.

Further in accordance with the above embodiment, the attachment includes a projection extending therefrom and engagable with one of the mounting blocks when the attachment is rotated about the rod into the operative position while being laterally moved along the rod into the locked position by a compressed spring, whereby the attachment is locked into the operative position substantially perpendicular to the rear surface.

Further in accordance with the above embodiment, one of the mounting blocks is provided with an opening for receiving the projection when the attachment is rotated into the operative position, and wherein the rod extends through the center of the opening and through the center of the projection along one of its axes, whereby the projection is received within the opening when the attachment is in the operative position.

Further in accordance with the above embodiment, the rod extends off-center through the projection along the other of its axes, whereby the projection is prevented from being received within the opening when the attachment is in the inoperative position.

BRIEF DESCRIPTION OF THE DRAWINGS

The above description, as well as further objects, features and advantages of the present invention, will be more fully understood by reference to the following detailed description of the presently preferred, but nonetheless illustrative, musical instrument support in accordance with the present invention when taken in conjunction with the accompanying drawings, wherein.

DETAILED DESCRIPTION

Figure 1:
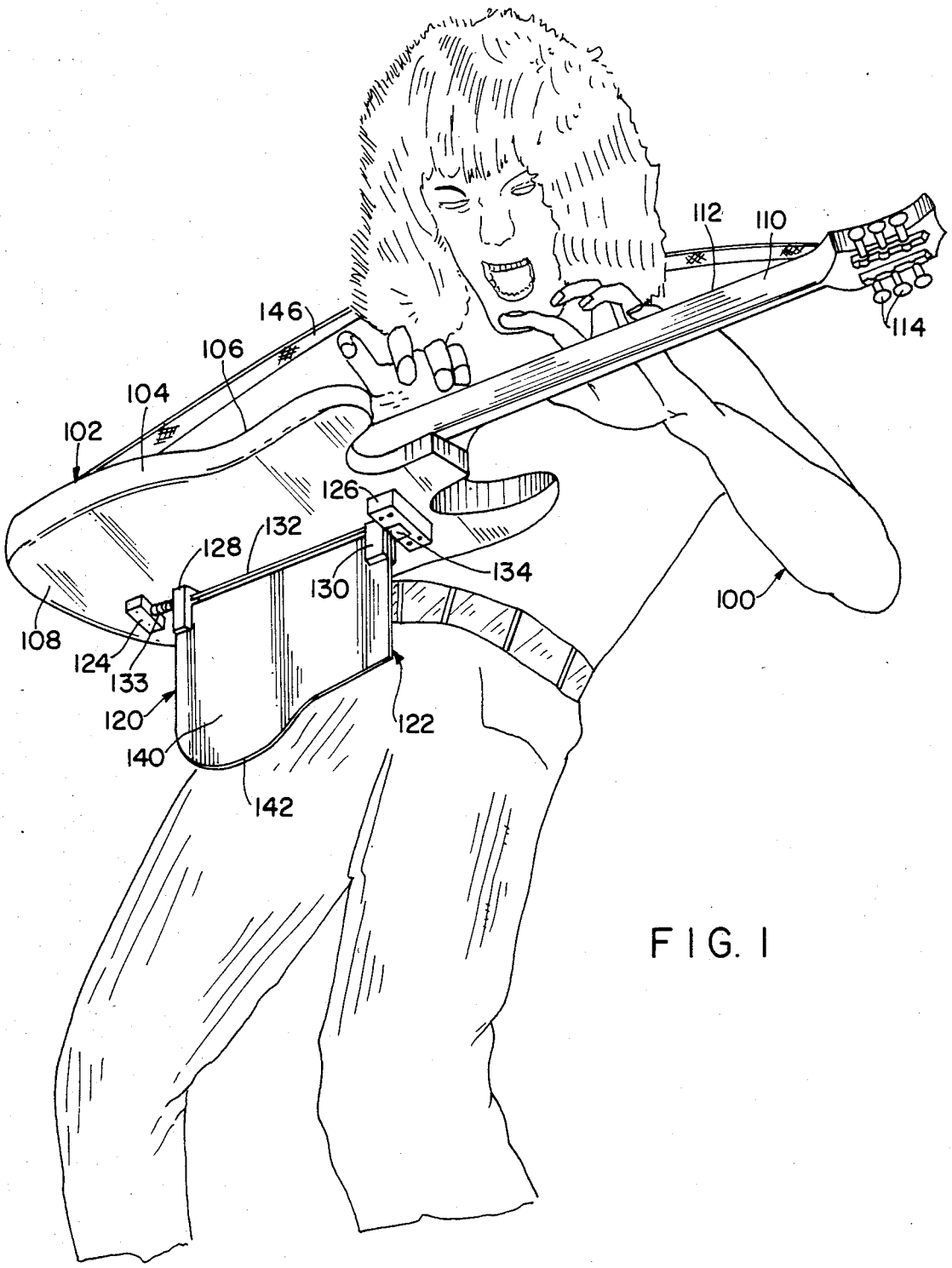
FIG. 1 is a perspective view showing the musical instrument support of the present invention mounted to the rear surface of a guitar for maintaining the guitar in a substantially perpendicular orientation to a player's body, while being played by a musician in a standing position with both hands free to explore the playing surface.

Referring now to the drawings, wherein like reference numerals represent like elements, there is shown in FIG. 1 a musician 100 playing a guitar 102, or other like stringed musical instrument such as a banjo, mandolin and the like. The guitar is constructed from a body 104 having a front surface 106 and rear surface 108. A longitudinally extending neck 110 having a fretted surface 112 and a plurality of tuning pegs 114 extends from the body 104 in a conventional manner. As shown in phantom in FIG. 4, a plurality of sound producing guitar strings 116 extend over a portion of the front surface 106 and frettted surface 112 between a bridge 118 and the tuning pegs 114. A supporting device 120 is mounted onto the rear surface 108 of the body 104 for positioning the guitar 102 in a substantially perpendicular orientation to the upper body of the musician 100. The supporting device 120 is constructed from an attachment 122, a pair of mounting blocks 124, 126, a pair of slide blocks 128, 130, a longitudinally extending rod 132 and a coiled spring 133. As more clearly shown in FIG. 2, the slide block 130 is L-shaped having a projection 134 protruding therefrom.

Referring again to FIG. 2, the mounting blocks 124, 126 are secured to the rear surface 108 of the guitar 102 in spaced-apart relationship by means of, for example, a plurality of screws or bolts. Mounting block 126 is U-shaped having an opening 136 and is mounted toward the neck 110 adjacent the edge of the guitar 102. Rod 132 is attached between the mounting blocks 124, 126 and overlying the rear surface 108 of the guitar 102. As more clearly shown in FIGS. 2 and 3, the rod 132 is located at the center of the opening 136 provided within the mounting block 126. The slide blocks 128, 130 are provided with a central opening, not shown, through which the rod 132 passes. In this manner, the slide blocks 128, 130 may be rotated about the rod 132, as well as being movable laterally therealong. The rod 132 is located off-center with respect to the Y-axis of the projection 134 of the slide block 130 and on center with respect to the X-axis.

Figure 4:
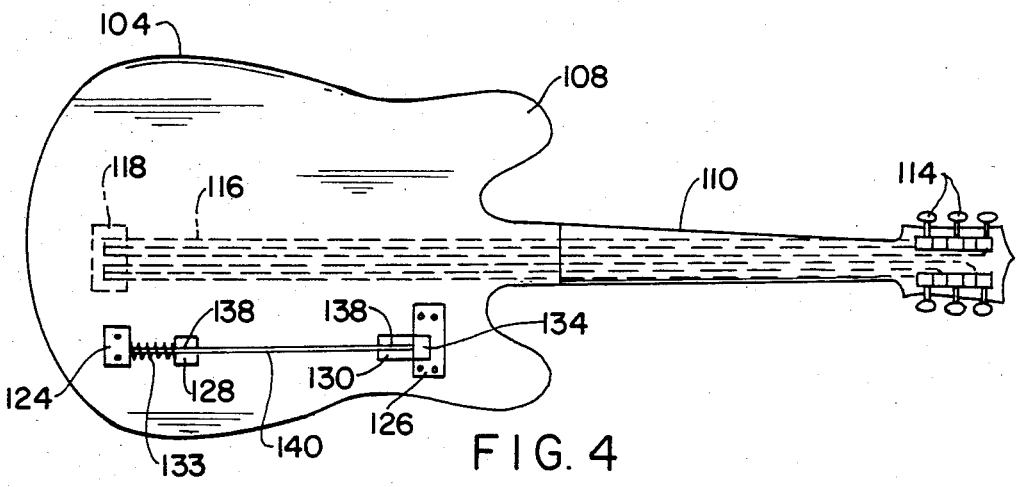
FIG. 4 is a rear view showing the musical instrument support locked in its operative position arranged substantially perpendicular to the rear surface of the guitar.

The slide blocks 128, 130 are spaced-apart with slide block 128 arranged adjacent mounting block 124 and slide block 130 arranged adjacent mounting block 126. The slide blocks 128, 130 are provided with a slot 138, as shown in FIG. 4, for securing the attachment 122 thereto by means of, for example, screws or bolts. The attachment 122 is constructed generally of a flat plate 140 having a contoured body engaging portion 142. As the mounting blocks 124, 126 are positioned adjacent one edge of the guitar 102, the plate 140 is located centrally over the rear surface 108 of the guitar. The coiled spring 133 is compressed about the rod 132 between the mounting block 124 and slide block 128.

Figure 2:
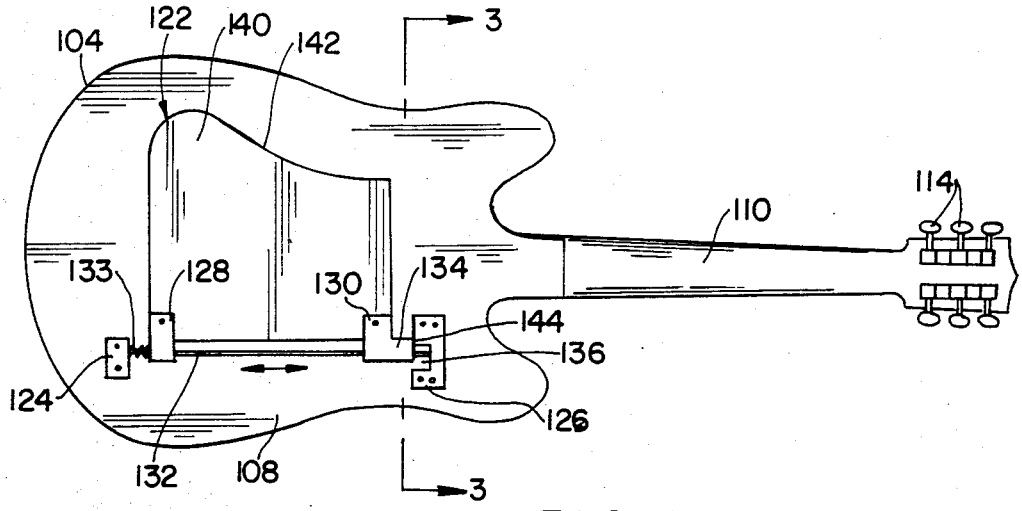
FIG. 2 is a rear view showing the musical instrument support in its inoperative position arranged adjacent the rear surface of the guitar to permit playing of the guitar in a conventional manner.
Figure 3:
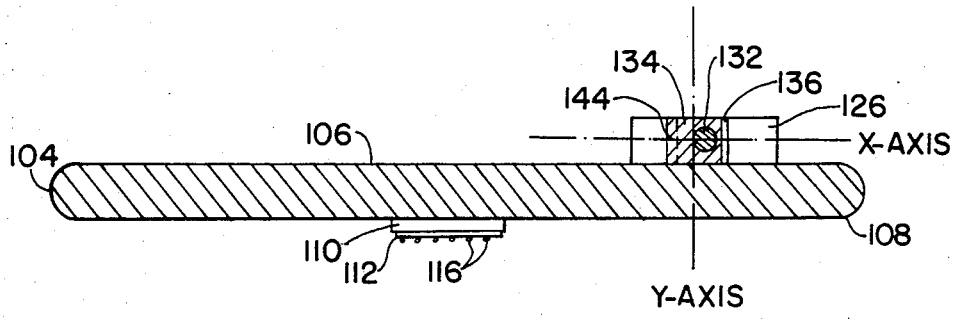
FIG. 3 is a cross-sectional view taken along line 3—3 of FIG. 2, showing the center and off-center mounting of the musical instrument support rod with respect to a mounting block and a projection of a slide block.

The construction of the supportng device 120 having now been described, the reader's attention is directed to FIGS. 1–4 in general, where a detailed description of the manner of operating and using the supporting device will now be described. In this regard, the supporting device 120 is illustrated in an inoperative position in FIGS. 2 and 3 and in an operative position in FIGS. 1 and 4. In the inoperative position, the attachment 122 is arranged overlying the rear surface 108 of the guitar 102. Spring 133 biases the attachment 122 along rod 132 towards the mounting block 126. As shown in FIG. 3, as the rod 132 is positioned off-center with respect to the Y-axis of the projection 134 of the slide block 130, a portion 144 of the projection engages an opposing portion of the mounting block 126, thereby acting as a stop and preventing engagement of the projection within the opening 136. The guitar 102 with the supporting device 120 being arranged in its inoperative position may be played in a conventional manner, that is, with the guitar being arranged in a substantially vertical orientation. As the attachment 122 is positioned adjacent and overlying the rear surface 108 of the guitar 102, the supporting device 120 will not interfere with the conventional playing of the guitar.

When it is desired to activate the supporting device 120, the musician 100 merely picks up the guitar 102 and rotates the body 104 into a substantially horizontal position. During rotation of the guitar 102, gravity causes the attachment 122 to rotate about rod 132. When the attachment 122 has achieved a substantially perpendicular orientation to the rear surface 108 of the guitar 102, the projection 134 of the slide block 130 will now be arranged in registration with the opening 136 of the mounting block 126. Once in registration, the spring 133 will cause the attachment 122 to be laterally moved along the rod 132 until the projection 134 of the slide block 130 is fully engaged within the opening 136 of the mounting block 126 as is shown in FIGS. 1 and 4. the attachment 122, now being in a locked position, is prevented from rotation from its substantially perpendicular operative position to its inoperative position overlying the rear surface 108 of the guitar 102. The ability of the projection 134 to engage the opening 136 is due to the fact that the rod 132 is positioned centrally of the projection along its X-axis, although being positioned off-center along its Y-axis to prevent engagement when in an inoperative position.

Turning now to FIG. 1, the guitar 102 is initially supported on the musician 100 by a strap 146 which is conventionally attached between one end of the body 104 and one end of the neck 110. The guitar 102 is maintained in a substantially perpendicular orientation to the body of the musician 100 by the engagement of the body engaging portion 142 of the attachment 122 with the musician's upper leg portion. Thus, by resting the body engaging portion 142 on the lower body portion of the musician 100, the guitar 102 may be maintained in a substantially perpendicular orientation without assisted support from the player's hands. The musician 100, having both hands free, may manipulate the guitar strings 116 to create new techniques and sounds previously unknown to any player. In addition, because the guitar 102 is maintained in a substantially perpendicular orientation, the player has maximum visibility of the entire playing surface, i.e., front surface 106, guitar strings 116 and fretted surface 112.

Upon completion of the musician's performance, or upon desired storage of the guitar 102, the attachment 122 is rotated back to its inoperative position overlying the rear surface 108 of the guitar. To inactivate the supporting device 120, the musician 100 merely grabs the attachment 122 and slides it laterally along the rod 132, so as to compress the spring 133 and disengaging the projection 134 from the opening 136 of the mounting block 126. Once disengaged, the attachment 122 is rotated about rod 132 to its inoperative position adjacent the rear surface 108 of the guitar 102, as shown in FIG. 2. The guitar 102 may now be played in the conventional manner, where it is arranged in a generally vertical orientation, or conveniently stored in a case without the necessity of providing specially constructed storage cases to accommodate the supporting device 120.

In accordance with the present invention, there has thus far been described a guitar constructed from an instrument body having front and rear surfaces, a neck extending from the instrument body and having a fretted surface, sound producing means extending over a portion of the front surface and the fretted surface, and a device mounted onto the rear surface for positioning the instrument body in an angular orientation to a guitar player's body, the device including a pair of spaced-apart mounting blocks attached to the rear surface, a rod extending between the mounting blocks, an attachment movably mounted to the rod for rotational movement between an operative and inoperative position and for lateral movement between a locked and unlocked position, the attachment overlying the rear surface when in the inoperative position and substantially perpendicular to the rear surface when in the operative position, the attachment having a portion engaging the player's body when in the operative position for maintaining the instrument body in the angular orientation, the portion disengaging from the player's body when in said operative position for maintaining the instrument body in other than the angular orientation, and a projection extending from the attachment and receivable within one of the mounting blocks when the attachment is rotated about the rod into the operative position and laterally moved along the rod into the locked position by the biasing means, whereby the attachment is locked in a position substantially perpendicular to the rear surface.

Although the invention herein has been described with reference to particular embodiments, it is to be understood that these embodiments are merely illustrative of the principles and application of the present invention. For example, although the invention has generally been described as maintaining the guitar body substantially perpendicular to the player's body, the invention may maintain the guitar body at other angular orientations with equal utility and possessing the disclosed advantages that result therefrom. It is therefore to be understood that numerous modifications may be made to the illustrative embodiments and that other arrangements may be devised without departing from the spirit and scope of the present invention as defined by the appended claims.

What is claimed is:

1. A stringed musical instrument comprising an instrument body having front and rear surfaces, sound producing means extending over a portion of said front surface, and a device mounted onto said rear surface for positioning said instrument body at an angular orientation to a player's body, said device including attachment means movable between an inoperative position overlying said rear surface and an operative position at an angle to said rear surface, a pair of spaced-apart mounting blocks attached to said rear surface and support means coupled to said mounting blocks for rotationally supporting therebetween said attachment means, said attachment means engaging said player's body when in said operative position for maintaining said instrument body in said angular orientation and disengaging from said player's body when in said inoperative position for maintaining said instrument body in other than said angular orientation.

2. The stringed musical instrument of claim 1 wherein said support means comprises a rod extending between said mounting blocks.

3. The stringed musical instrument of claim 2 wherein said attachment means is movably mounted on said rod for rotational movement between said operative and inoperative positions and for lateral movement between a locked and unlocked position.

4. The stringed musical instrument of claim 3 wherein said attachment means is mounted on said rod by a pair of spaced-apart slide blocks.

5. The stringed musical instrument of claim 3 wherein said device further includes biasing means for biasing said attachment means towards said locked position.

6. The stringed musical instrument of claim 5 wherein said biasing means comprises a spring located about said rod and arranged between said mounting blocks and said attachment means.

7. The stringed musical instrument of claim 5 wherein said attachment means includes a projection extending therefrom and engagable with one of said mounting blocks when said attachment means is rotated about said rod into said operative position while being laterally moved along said rod into said locked position by said biasing means, whereby said attachment means is locked in said operative position.

8. The stringed musical instrument of claim 7 wherein said projection comprises a portion of an L-shaped member by which said attachment means is mounted on said rod.

9. The stringed musical instrument of claim 7 wherein said one of said mounting blocks has an opening for receiving said projection when said attachment means is rotated into said operative position.

10. The stringed musical instrument of claim 9 wherein said rod extends through the center of said opening and through the center of said projection along one of its axes, whereby said projection is received within said opening when said attachment means is in said operative position.

11. The stringed musical instrument of claim 10 wherein said rod extends off-center through said projection along the other of its axes, whereby said projection is prevented from being received within said opening when said attachment means is in said inoperative position.

12. A guitar comprising an instrument body having front and rear surfaces, a neck extending from said instrument body and having a fretted surface, sound producing means extending over a portion of said front surface and said fretted surface, and a device mounted onto said rear surface for positioning said instrument body at an angular orientation to a guitar player's body, said device including a pair of spaced-apart mounting blocks attached to said rear surface, a rod extending between said mounting blocks, attachment means movably mounted to said rod for rotational movement between an operative and inoperative position and for lateral movement between a locked and unlocked position, said attachment means overlying said rear surface when in said inoperative position and at an angle to said rear surface when in said operative position, said attachment means having a portion engaging said player's body when in said operative position for maintaining said instrument body in said angular orientation, said portion disengaging from said player's body when in said inoperative position for maintaining said instrument body in other than said angular orientation, and a projection extending from said attachment means and received within one of said mounting blocks when said attachment means is rotated about said rod into said operative position and laterally moved along said rod into said locked position, whereby said attachment means is locked in a position at an angle to said rear surface.

13. The guitar of claim 12 wherein said device further includes biasing means for biasing said attachment means towards said locked position.

14. The guitar of claim 13 wherein said biasing means comprises a spring located about said rod and arranged between one of said mounting blocks and said attachment means.

15. The guitar of claim 12 wherein said one of said mounting blocks has an opening for receiving said projection when said attachment means is in said operative position.

16. The guitar of claim 15 wherein said rod extends through the center of said opening and through the center of said projection along one of its axes, whereby said projection is received within said opening when said attachment means is in said operative position.

17. The guitar of claim 16 wherein said rod extends off-center through said projection along the other of its axes, whereby said projection is prevented from being received within said opening when said attachment means is in said inoperative position.

18. The guitar of claim 12 wherein said projection comprises a portion of an L-shaped member by which said attachment means is mounted on said rod.

19. The guitar of claim 12 wherein said attachment means is rotated about said rod by the force of gravity when said instrument body is moved from a substantially vertical orientation toward a substantially horizontal orientation.

20. The guitar of claim 12 wherein said attachment means is mounted to said rod by a pair of spaced-apart slide blocks.

21. The guitar of claim 12 wherein said angular orientation comprise a substantially perpendicular orientation.

22. The guitar of claim 12 wherein said angle comprises a substantially perpendicular angle.

* * * * *